United States Patent [19]

Beers

[11] 4,328,632

[45] May 11, 1982

[54] FIREARM CLEANING DEVICE

[76] Inventor: John W. R. Beers, 1355 Merrifield, Niles, Mich. 49120

[21] Appl. No.: 139,718

[22] Filed: Apr. 14, 1980

[51] Int. Cl.[3] ..... F41C 31/00; F42B 5/24; F42B 9/22

[52] U.S. Cl. ..... 42/1 BC; 102/440; 102/442

[58] Field of Search ..... 42/1 BC; 89/1 R; 102/529, 440, 442

[56] References Cited

U.S. PATENT DOCUMENTS

| | | | |
|---|---|---|---|
| 938,836 | 11/1909 | Fessenden | 102/442 |
| 1,495,008 | 5/1924 | Feagin | 102/442 |
| 2,375,314 | 5/1945 | Mills | 89/1 R |
| 3,147,708 | 9/1964 | Ferguson | 42/1 BC |
| 3,476,047 | 11/1969 | Davis | 102/442 |
| 3,740,883 | 6/1973 | Kyle | 42/1 BC |

*Primary Examiner*—Charles T. Jordan
*Attorney, Agent, or Firm*—Marmaduke A. Hobbs

[57] ABSTRACT

A cleaning device for firearms having a firing pin and a barrel with a shell chamber, in which a casing contains several barrel cleaning layers consisting of an abrasive, solvent, wiper and lubricant layers. A propellant is disposed in the casing in close proximity to the firing pin which activates the propellant to propel the cleaning layers through the barrel. The propellant may be a cartridge containing $CO_2$, having a neck and cap in close proximity to the firing pin which strikes and ruptures the cap to release the $CO_2$ and drive the cleaning layers through the barrel. A soft fabric may be disposed around the cartridge, and may be impregnated with lubricant for treating the barrel after the cleaning layers have passed therethrough.

13 Claims, 3 Drawing Figures

FIREARM CLEANING DEVICE

Sporting arms such as shotguns and rifles are normally cleaned using a cleaning rod which has a handle on one end and an eye on the other end for holding cleaning pads or patches and the like used at various stages in the cleaning procedure. For effective cleaning and conditioning of the bore of the barrel, the eye is often interchanged with a wire brush or other type of abrasive device for loosening burnt powder and lead deposits, which can then easily be wiped from the barrel by a pad. A solvent is also often used by applying it to the wall of the barrel, either before or after using the wire brush. After the brush or other abrasive device and the solvent have been used, the surface of the bore is wiped with the cleaning patch to remove the residue, and is then normally lubricated to protect it from corrosion. It is apparent that to clean a gun in the conventional manner, a number of pieces of equipment and materials are required to perform the complete cleaning operation. When the cleaning operation is done in the home or shop, the inconvenience of using a number of separate pieces or parts is usually not important; however, if the cleaning is to be done in the field, or temporary camp, or on a hunting trip in a vehicle, the use of a number of interchangeable pieces can involve such inconvenience that routine cleaning, which should be done to properly protect the barrel bore from corrosion and pitting, is neglected or entirely omitted and postponed until the gun owner returns from the trip. It is therefore one of the principal objects of the present invention to provide a firearm cleaning device which is small in size and easy to use under most field and camping conditions, and which contains in a single unitary structure all of the essential components for loosening burnt powder and lead deposits, and applying a solvent and lubricant to the side walls of the bore, all in one operation.

Another object of the invention is to provide a firearm cleaning device which can be loaded into the shell chamber of the gun and discharged to perform any one or all of the necessary steps of a barrel bore cleaning procedure, and which can be carried with the shooting equipment as easily as shells, and can conveniently be carried in the hunter's pockets or back pack.

Still another object is to provide a firearm cleaning device of the aforesaid type which can be reloaded to contain all of the essential components for cleaning the bore of a shotgun or rifle, and which contains a dischargeable propellant activated by the firearm firing system for activating the cleaning device.

A further object of the invention is to provide a firearm cleaning device which is so constructed and designed that it simulates a casing of a shell in size and appearance, and which can be used effectively to clean the bore of a shotgun or rifle at the end of each day of hunting or shooting before the hunter or shooter leaves the field, thus placing the firearm in condition for storage as soon as the shooting of the firearm has been completed.

Additional objects and advantages of the present invention will become apparent from the following description and accompanying drawings wherein.

Figure 1:
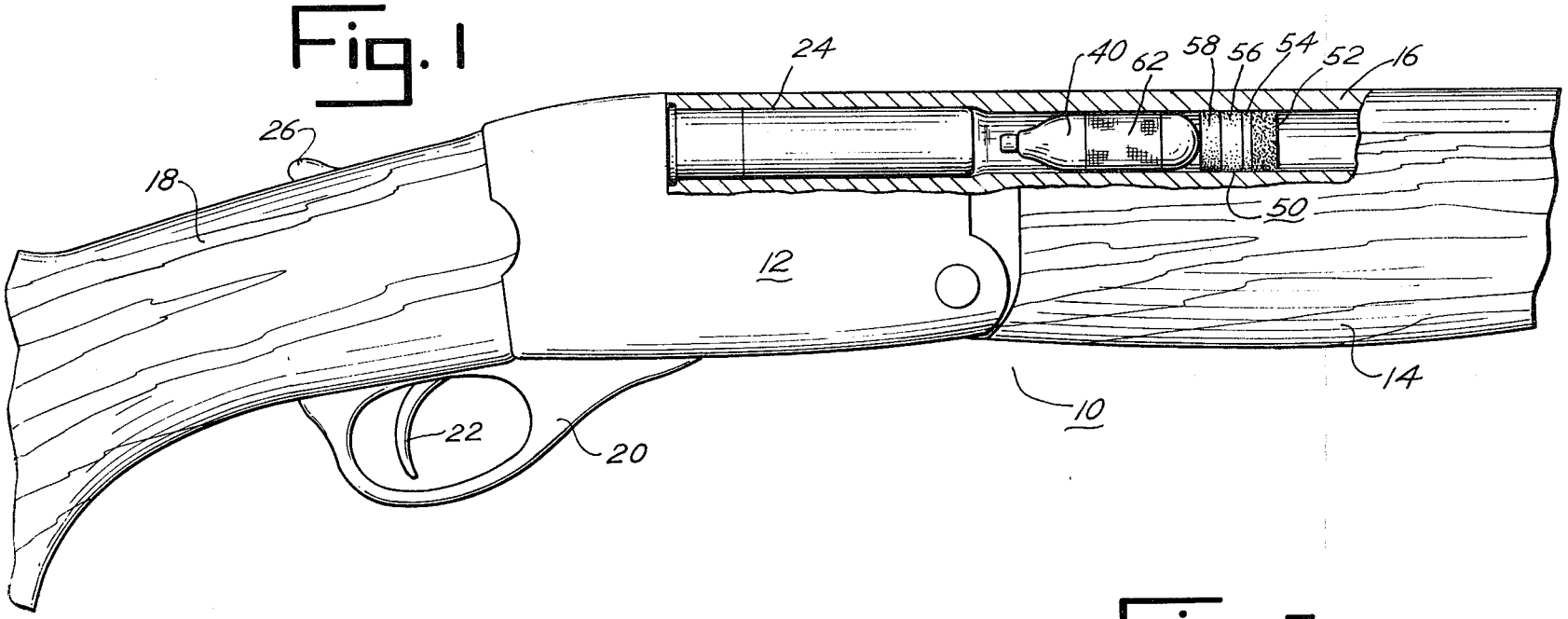
FIG. 1 is a fragmentary cross sectional view of a shotgun showing the present firearm cleaning device therein after it has been activated.

Referring more specifically to the drawing, and to FIG. 1 in particular, numeral 10 indicates generally a shotgun having a receiver 12, fore-end 14, barrel 16 and stock 18. The trigger assembly, indicated by numeral 20, releases a hammer when trigger 22 is pulled to propel a firing pin forwardly in the receiver through an opening into the end of chamber 24 of barrel 16. The gun is opened by lever 26 which permits the barrel and the fore-end to pivot downwardly relative to receiver 12, exposing the end of chamber 24, thus permitting a shell to be loaded into the chamber and the fired casing removed therefrom. The diameter of the barrel adjacent the chamber is slightly smaller than the diameter of the chamber. The present firearm cleaning device 30 is shown in FIG. 1 immediately after it has been activated, with some of the parts separated from one another in the performance of the cleaning operation.

The present firearm cleaning device, which may be used for a variety of different types of firearms, such as shotguns, rifles, pistols and revolvers, consists of a casing 32 having a base 34 with a flange 36 around end 38, and receiving a propellant 40 which, in the embodiment illustrated in the drawings, is a conventional $CO_2$ cartridge. The small end 42 of the cartridge is sealed by a cap 44 which extends into a hole 46 in the center of end 38 of base 34. When the cleaning device is loaded in the chamber as indicated in FIG. 1, the center of cap 44 is in alignment with the firing pin, and preferably substantially flush with the outer end surface 38 of base 34 so that, when the hammer strikes the firing pin, the pin punctures the cap to release the $CO_2$ in the cartridge. The casing 32 may be of plastic, paper or metal, and is preferably sufficiently cheap in construction that it can be economically discarded after the cleaning device has been operated.

Mounted in the forward end of casing 32 is a combination wad indicated generally by numeral 50. The first component consists of layer 52 of brass, copper or aluminum wool which will engage the internal surface of the barrel and loosen and scrape from the surface any residual burnt powder or lead or other metal deposit thereon. The second layer 54 is preferably a layer of absorbent material such as a cotton wad or fabric impregnated with a solvent or cleaning compound which may dissolve and/or further loosen the burnt powder or lead on the inner surface of the barrel. The next layer 56 preferably consists of a wiping pad of cotton or fabric, and may be thoroughly dry so that it will readily absorb the solvent and any residual burnt powder and loosened lead or other material left on the barrel surface after firing of the gun. The fourth layer 58 shown in the drawings consists of a porous material such as a cotton wad or fabric impregnated with a lubricant or other metal preservative which will be forced by pressure during the cleaning operation from the pad onto the inner surface of the barrel. The combination wad 50 is sealed in the end of the casing by the forward margin 60 thereof being folded over the end of the combination wad and crimped so that it will stay in the folded position and seal the liquids in the various layers in the wad. A further layer 62, consisting of a fabric or the like disposed around cylinder 40, is preferably used for the purpose of either wiping excess oil or metal preservative from the internal surface of the barrel or applying an additional layer of lubricant or preservative and effectively spreading the lubricant or preservative applied to the inner surface of the barrel.

Figure 3:
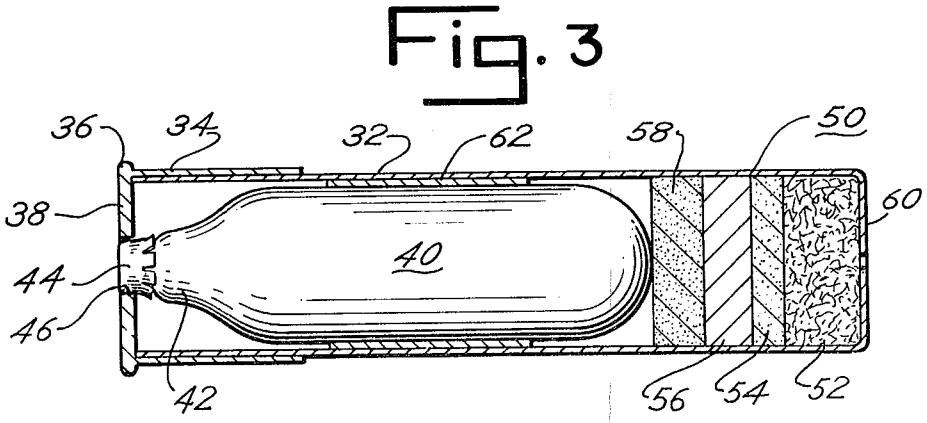
FIG. 3 is a longitudinal cross sectional view of the firearm cleaning device shown in FIG. 2, the section being taken on line 3—3 of the latter figure.
Figure 2:
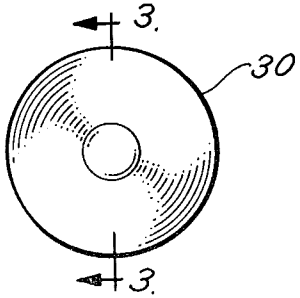
FIG. 2 is an end elevational view of the firearm cleaning device embodying the present invention.

In the use and operation of the present firearm cleaning device assembled in the manner indicated in FIG. 3, the gun is opened by operating lever 26, which releases the barrel and fore-end so that it pivots clockwise downwardly as viewed in FIG. 1, exposing the breech end of chamber 24. The cleaning device, which resembles an unfired shell, is inserted in the chamber and the gun is then closed to the position illustrated in FIG. 1. The gun is pointed in a safe, unobstructed direction, or toward an object which will effectively absorb the components and $CO_2$ cartridge when the latter is discharged, and the firing pin is actuated by the hammer in receiver 12 when trigger 22 is pulled. When the firing pin strikes cap 44, the cap is punctured, releasing $CO_2$ gas which rapidly propels the $CO_2$ cartridge and combination wad 50 forwardly through the barrel of the gun, as illustrated in FIG. 1.

As wad 50 advances through the barrel, the abrasive action of the metal wool of layer 52 scrapes the inner surface of the barrel to loosen the residual burnt powder and lead, some or most of which is then embedded on or near the surface of the periphery of layer 52 and is carried through the barrel and out the end thereby. Immediately following is the solvent layer 54 which further loosens any residual material remaining on the internal surface of the barrel, and then cleaning layer 56 which wipes the surface to remove the solvent and loosened and dissolved residual material. This is immediately followed by layer 56 which applies a thin film of a lubricant or metal preservative on the inner surface of the barrel to protect it when the gun is stored. An additional film or lubricant and/or preservative may be applied and the film spread effectively over the surface by cloth layer 62 mounted securely on the external surface of cartridge 40. As the $CO_2$ is discharged, the wad 50 and the cartridge are propelled rapidly through and out the end of the barrel and will normally travel several yards before falling to the earth, unless they strike a shock absorbent structure such as the ground, bale of straw or other such object.

The primary place in which the present cleaning device is used is in the field or on hunting trips, where the firearm cannot easily be cleaned after each trip into the field, or from day to day during an extended hunting trip. The use of the cleaning device effectively cleans the barrel of the gun to prevent corrosion which might otherwise result from the residue or from moisture absorbed by the residue if permitted to remain on the inner surface of the barrel for an extended period of time.

Various layers of combination wad 50 may be used to obtain the most effective cleaning operation for any particular type of firearm or shell used in the firearm, or conditions under which the firearm is used. Further, a different type of propellant, including an explosive propellant with a firing cap in place of cap 44, may be used, provided residue from the propellant will not foul the inner surface of the firearm barrel after it has been cleaned by the components of wad 50 of the cleaning device. Also, the device may be constructed without the casing, using the side walls of the cartridge as the base and attaching a combination wad to the forward end thereof. The components of the wad and layer 62 may be protected by a sealed wrapper enclosing the sides and end of the assembled device. The use of the term "casing" in the claims is intended to include such a wrapper.

While only one embodiment of the present gun cleaning device has been described in detail herein, various changes and modifications may be made without departing from the scope of the invention.

I claim:

1. A cleaning device for firearms having a firing pin and a barrel with a shell chamber, comprising a casing for seating in said shell chamber with one end adjacent the firing pin, a cleaning means disposed in the other end of said casing, propellant means consisting of a cylindrical cartridge ejectably disposed in the end of said casing adjacent the firing pin to discharge a gas in said casing for propelling said cleaning means and said cylindrical cartridge through said barrel in contact with the inside walls thereof, when said propellant means is activated by the action of the firing pin, and a pad of soft material disposed around and secured to the sides of said cartridge and surrounded by said casing before the device is activated.

2. A cleaning device for firearms as defined in claim 1 in which said cleaning means includes a first layer of an abrasive material for loosening powder and metal residue from the inside walls of the barrel when the device is activated.

3. A cleaning device for firearms as defined in claim 1 in which said cleaning means includes a layer of absorbent cloth-like material for wiping the inside wall of the barrel when the device is activated.

4. A cleaning device for firearms as defined in claim 2 in which said cleaning means includes a layer of absorbent cloth-like material posterior to said first layer, for wiping the inside wall of the barrel when the device is activated.

5. A cleaning device for firearms as defined in claim 1 in which said cleaning means includes a layer of material with a lubricant for applying lubricant to the inside wall of the barrel when the device is activated.

6. A cleaning device for firearms as defined in claim 2 in which said cleaning means includes a layer of material with a lubricant posterior to said first layer, for applying lubricant to the inside wall of the barrel when the device is activated.

7. A cleaning device for firearms as defined in claim 3 in which said cleaning means includes a layer of material with a lubricant posterior to said first mentioned layer, for applying lubricant to the inside wall of the barrel when the device is activated.

8. A cleaning device for firearms as defined in claim 1 in which said cleaning means includes a layer of material having a solvent therein for assisting in removing the residue in the barrel.

9. A cleaning device as defined in claim 7 in which a layer of material having a solvent therein is disposed between said abrasive layer and said wiping layer.

10. A cleaning device for firearms as defined in claim 4 in which said cleaning means includes a layer of material with a lubricant for applying lubricant to the inside wall of the barrel when the device is activated.

11. A cleaning device for firearms as defined in claim 3 in which said cleaning means includes a layer of material with a lubricant for applying lubricant to the inside wall of the barrel when the device is activated.

12. A cleaning device for firearms as defined in claim 1 in which said cartridge contains $CO_2$ and has a neck with a rupturable end adjacent to and facing the firing pin.

13. A cleaning device for firearms as defined in claim 1 in which said soft material contains a lubricant.

* * * * *